US006309697B1

(12) United States Patent
Scherer et al.

(10) Patent No.: US 6,309,697 B1
(45) Date of Patent: Oct. 30, 2001

(54) COMPOSITION FOR TEMPORARILY PROTECTING METAL COMPONENTS FROM CORROSION, ITS PROCESSES OF PREPARATION AND OF APPLICATION, AND METAL COMPONENTS OBTAINED FROM THIS COMPOSITION

(75) Inventors: Lothaire Scherer, Fos sur Mer; Ronald Kefferstein, Saint Victoret; Philippe Antoine, Allée des Tilleuls, all of (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 09/446,887

(22) PCT Filed: Jun. 23, 1998

(86) PCT No.: PCT/FR98/01317

§ 371 Date: Mar. 13, 2000

§ 102(e) Date: Mar. 13, 2000

(87) PCT Pub. No.: WO99/01590

PCT Pub. Date: Jan. 14, 1999

(30) Foreign Application Priority Data

Jul. 1, 1997 (FR) ..... 97 08288

(51) Int. Cl.[7] ..... B05D 7/14
(52) U.S. Cl. ..... 427/156; 427/388.4
(58) Field of Search ..... 427/388.4, 156

(56) References Cited

U.S. PATENT DOCUMENTS 2,218,557 10/1940 Shoemaker .
3,597,152 8/1971 Shaw .
5,347,008 * 9/1994 Bentley et al. ..... 548/170

FOREIGN PATENT DOCUMENTS 33 41 633 5/1985 (DE) .
0 126 030 11/1984 (EP) .
0 161 222 11/1985 (EP) .
0 192 132 8/1986 (EP) .
0 129 506 12/1987 (EP) .
0 577 486 1/1994 (EP) .
2 325 730 4/1977 (FR) .
1028924 5/1966 (GB) .
WO 91/05033 4/1991 (WO) .

OTHER PUBLICATIONS

Patent Abstracts of Japan, vol. 011, No. 365 (C–460), AN 60278573, Nov. 27, 1987, JP 62 136580, Jun. 19, 1987.

* cited by examiner

*Primary Examiner*—Erma Cameron
(74) *Attorney, Agent, or Firm*—Oblon, Spivak, McClelland, Maier & Neustadt, P.C.

(57) ABSTRACT

The invention concerns a composition useful for providing temporary protection against corrosion to metal surfaces comprising an oil-in-water emulsion characterised in that said emulsion contains in its aqueous phase at least a compound of general formula (I) in which the groups R, $R_1$ and $R_2$ represent independently of one another a hydrogen atom, a $C_1$–$C_{20}$ alkyl group, a $C_1$–$C_{20}$ halogenoalkyl group with the halogen being chlorine, bromine, iodine or fluorine, a $C_3$–$C_6$ cycloalkyl group, a carboxylic function or a $C_1$–$C_6$ carboxyalkyl group; n is a whole number varying from 1 to 3; and X represents an oxygen or sulphur atom in the form of one of its soluble salts. The invention also concerns a method for preparing said composition, its method of application to the surface of metal part and the resulting part.

20 Claims, 6 Drawing Sheets

COMPOSITION FOR TEMPORARILY PROTECTING METAL COMPONENTS FROM CORROSION, ITS PROCESSES OF PREPARATION AND OF APPLICATION, AND METAL COMPONENTS OBTAINED FROM THIS COMPOSITION

A subject-matter of the present invention is a composition of use in temporarily protecting metal components from corrosion, a process for the preparation of the said composition and the metal components coated with a dry film deriving from this composition.

The problem of the temporary protection of metal surfaces and more particularly of sheet metal from atmospheric corrosion is a constant preoccupation of manufacturers. Multiple possibilities therefore already exist for conferring, on the surface of the metal sheet, a form of temporary protection by fatty films, in particular based on conventional protecting oils.

However, the increase in the requirement criteria of users has led steel manufacturers to provide increasingly elaborate solutions which take into account highly varied factors (appearance, suitability for surface treatment, cleanliness of the premises, safety, toxicology and the like). These imperatives have thus been partially satisfied by the development of a non-fatty coating and of its method of application, the qualities of which confer properties of temporary protection from corrosion of the order of two months on the metal sheet thus treated (FR 92 08 037).

However, there remains a demand on the part of users for coatings which exhibit an even better corrosion stability, without, of course, prejudicing the subsequent properties of use, and in particular possess a prolonged corrosion stability with, preferably, a corrosion resistance of greater than three months.

It is a specific object of the present invention to provide a novel coating in accordance with these requirements.

A first approach consists in incorporating one or more corrosion inhibitors in coatings has base of formulations of oils for temporary protection.

Conventionally, the corrosion inhibitors present in protecting oils are chosen from:

amino compounds of alcoholamine type, sulphonate derivatives, such as their barium or sodium salts, or alkylbenzenesulphonates, and acids of linoleic type.

Unfortunately, the increase in corrosion resistance obtained with these conventional inhibitors is not satisfactory.

There consequently remains to this day a need for a method for the temporary protection of metal components which is significantly improved in terms of corrosion resistance (greater than three months), a dry appearance and suitability for surface treatment, with or without preparation, and which, in addition, conforms to the toxicology rules (absence of barium, of heavy metal salts, and the like).

Thus it is that the Applicant Company has demonstrated that the incorporation within an oil-in-water emulsion of a heterocyclic thioether of saturated carboxylic acids, as corrosion inhibitor, would make it possible specifically and satisfactorily to meet all these requirements.

More specifically, the present invention relates to a composition of use in conferring temporary protection from corrosion on metal surfaces comprising an oil-in-water emulsion, characterized in that the said emulsion comprises, in its aqueous phase, at least one compound of general formula I (I)

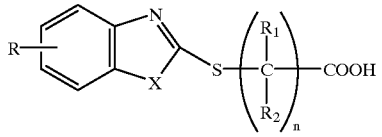

in which formula the R, $R_1$ and $R_2$ groups are, independently of one another, a hydrogen atom, a $C_1$ to $C_{20}$ alkyl group, a $C_1$ to $C_{20}$ haloalkyl group, with the halogen being able to be fluorine, chlorine, bromine or iodine, a $C_3$ to $C_6$ cycloalkyl group, a carboxyl functional group or a $C_2$ to $C_6$ carboxyalkyl group, n is an integer varying from 1 to 3, and X is a sulphur or oxygen atom, in the form of one of its water-soluble salts.

It is preferably a compound of general formula I in which R is a hydrogen atom and X a sulphur atom.

Unexpectedly, the addition of a corrosion inhibitor in accordance with the present invention to an oil-in-water emulsion confers a corrosion resistance on the corresponding coating which is very significantly prolonged over time. This improvement is in fact much greater than that expected, that is to say that equivalent to the superimposition of the respective effects of the emulsion and of the said inhibitor in terms of corrosion resistance. It is advantageously the reflection of a synergy between the two components.

The novelty of the claimed composition is additionally based on the incorporation of a compound of general formula I in the aqueous phase and not in the lipid phase of the emulsion employed in the claimed composition. This compound, which is water-insoluble in nature, is therefore present in the composition in a neutralized form for the purpose of conferring a satisfactory solubility in water on it.

This neutralization of the compound or compounds of formula I employed according to the invention can be carried out conventionally by a person skilled in the art. It can be obtained, for example, from aqueous ammonia, morpholine, ethanolamine, ethanol or potassium hydroxide. Depending on the reagent employed, it may be necessary, if appropriate, to adjust the pH of the final composition to a value compatible with the recommended application, that is to say to a value of between 8.2 and 9.5 and preferably between 8.5 and 9. This can be easily carried out by adjusting the pH of the final emulsion by a further addition of neutralizing agent, such as ethanolamine, for example.

The corrosion inhibitor of general formula I is preferably present in the claimed composition in a proportion of 1 to 10 g/l and preferably of 1 to 3.5 g/l.

Mention will very particularly be made, as preferred compounds of general formula I, of the water-soluble salts of benzothiazolylthiosuccinic, α-(benzo-thiazolylthio) stearic, α-(benzooxazolylthio)lauric, α-(benzothiazolylthio) caproic and α-(benzothiazolylthio)-caprylic acids.

It is more preferably a water-soluble form of benzothiazolylthiosuccinic acid (BTSA) and more specifically its ammonium or ethanolamine salt.

As regards the emulsion, it can be defined as comprising, in dispersion in water, 3 to 13% by volume of an oily phase comprising from 75 to 90% by volume of at least one oil and from 5 to 10% by volume of at least one surface-active agent. If appropriate, a supplementary corrosion inhibitor can be present in a proportion of 5 to 15% by volume in the oily phase.

The emulsion preferably comprises, in dispersion in the aqueous phase, between approximately 3 and 8% and preferably approximately 6% by volume of an oil.

The oil present in the oily phase of the emulsion can be composed of a mineral, vegetable or animal oil.

It is advantageously a mineral oil and preferably an oil of paraffinic or naphthenic type or a mixture of these.

Mention will very particularly be made, as mineral oil preferably employed according to the present invention, of the soluble oil Aquasafe 21® from Castrol.

It is preferable to use, as surface-active agent of the oily phase, a surfactant of polyoxyethylene type.

Use is advantageously made, as corrosion inhibitor of the oily phase, of a carboxylic acid, a barium or sodium alkylsulphonate or a fatty acid amine salt.

According to a preferred form of the invention, the claimed composition comprises, as corrosion inhibitor, a water-soluble salt of benzothiazolylthiosuccinic acid (BTSA) present, at a concentration of between 1 and 3.5 g/l and preferably of the order of 2.5 g/l, in the aqueous phase of an emulsion comprising 6% of soluble oil which is preferably the oil Aquasafe 21® from Castrol. It is preferably the ammonium salt of benzothiazolylthiosuccinic acid present at a concentration of the order of 2.5 g/l.

The present invention also relates to a process for the preparation of the said composition.

More particularly, this process is characterized in that the compound or compounds of general formula I are incorporated in the form of an aqueous solution in the aqueous phase of the emulsion prior to its emulsification with the oily phase.

This is because the Applicant Company has noticed, unexpectedly, that the method of incorporation of the compound of general formula I in the emulsion has a significant effect on the anticorrosion activity of the corresponding composition. Thus it is that it proves to be particularly advantageous to introduce this compound of general formula I into the emulsion in the form of an aqueous solution. It thus remains dispersed in the aqueous phase of the emulsion. This is because it has been observed that the addition of this compound directly to the oily phase of the said emulsion significantly affected the anticorrosion behaviour of the resulting composition. This effect is more specifically demonstrated in Examples 7 and 9 below.

Another subject-matter of the present invention is a process for temporarily protecting metal components from corrosion.

More particularly, this process is characterized in that it comprises the stages consisting in:

applying a composition according to the invention to at least a part of the said metal component, and drying the said coated metal component until a dry film is obtained.

According to a favoured form of the invention, the composition according to the invention is applied to the surface of the metal component so as to saturate its absorption sites with compounds of general formula I and that, on conclusion of the heating of the said composition, in order to obtain a film therefrom, compound of general formula I is not found present in the thickness of the applied film.

This is because the performance of the coating film proves to be markedly improved if the application of the claimed composition to the metal plate to be treated is carried out so as to saturate its adsorption sites with a compound of general formula I and to prevent the accumulation of this same compound of general formula I in the thickness of the film.

It is therefore desirable to adapt its method of application so as to optimize this saturation of the adsorption sites of the treated surface and to minimize, on the other hand, the concentration of compounds of general formula I in the thickness of the emulsion film after drying. The parameters to be considered, for this adjustment of the concentration of the claimed composition at the surface of the treated plate, are the desired thickness of the film and the concentration of oily phase and of compound of general formula I in this composition. It is within the scope of a person skilled in the art to carry out this adjustment by routine operations taking into account these various parameters.

The adjustment of the optimum concentration of inhibitor of general formula I at the surface of the metal component to be treated can, for example, be assessed and carried out in the following way, after having applied and dried, at the surface of the component, a composition according to the invention with a predetermined concentration of corrosion inhibitor(s) of general formula I. The component is leached with acetone, by steeping or by spraying. The level of saturation of the adsorption sites at the surface of the treated metal component is then measured by running an infrared spectrum of the leached component using the technique of 80° grazing incidence Fourier transform infrared (FTIR) spectroscopy. The fact that an interfacial film rich in inhibitors of general formula I remains or does not remain on conclusion of this leaching, as well as the residual thickness of this film, are already indices with regard to the degree of adsorption of the said inhibitor. By comparison with infrared spectra run on other components treated with compositions exhibiting different concentrations of inhibitor and leached in the same way, it is subsequently possible to determine whether or not the adsorption sites of the metal surface are saturated, that is to say whether the concentration of inhibitor is sufficient in the composition to produce an effective treatment.

It is subsequently confirmed that a composition has not been applied to the component which is so concentrated in inhibitor that saturation of the adsorption sites would have been exceeded to the point where a significant portion of the inhibitor of the composition would be found in the thickness of the dry film applied to the metal surface. To this end, the content of inhibitor in the leachate is analysed, for example also by infrared spectroscopy. By comparison with infrared spectra run on leachates originating from other components treated with compositions exhibiting different concentrations of inhibitor and leached in the same way, it is then possible to determine whether the concentration of inhibitor in the composition is too high to produce an effective treatment.

The concentration of inhibitor in the composition is thus adjusted.

The aqueous composition according to the invention can, of course, be deposited in the form of a film at the surface of the metal components to be protected by any appropriate conventional means of roller coating device type or similar or alternatively by spraying. The component thus treated is subsequently dried in order to obtain a dry film in accordance with the invention.

This heating can be carried out, for example, by bringing the treated component to a temperature of between 50 and 100° C. for a time varying between approximately 20 seconds to 10 minutes.

Another subject-matter of the present invention is a metal component coated with a dry film for temporary protection from corrosion obtained from the claimed composition and/or in accordance with the claimed processes.

The surface density of dry film at the surface of the component preferably varies between 0.3 and 2 $g/m^2$ and more preferably is of the order of 0.5 $g/m^2$.

Within the meaning of the invention, the term "metal components" is understood to mean moderately thick hot rolled plates, hot rolled thin metal sheets, cold rolled steel sheets and various types of steel plates and sheets, in particular of bare steel.

As stated above, the metal components coated with a dry protective film with a composition as defined according to the invention prove to be resistant to corrosion and display good suitability for stamping and bonding. What is more, the dry films obtained according to the claimed process display good properties of adhesion with regard to substrates of varied natures, at the surface of which substrates they are capable of being applied at their surface.

Furthermore, the coatings deriving from the claimed compositions have tribological performances which are satisfactory and therefore advantageous with regard to stamping. Thus it is that their characterization in terms of friction shows that they exhibit a reduced coefficient of friction in comparison with conventional coatings.

The compositions according to the invention can, in addition, be applied effectively to metal plates which are already coated with a dry film and therefore prove to be particularly advantageous in treating external turns and edges of a coil which are already coated with a non-fatty coating or in protecting pickled metal components.

Other advantages of the claimed composition will become apparent on reading the examples presented below without implied limitation of the present invention.

I—MATERIAL AND METHOD

A) Material

A. 1—Corrosion inhibitors tested

Figure 1:
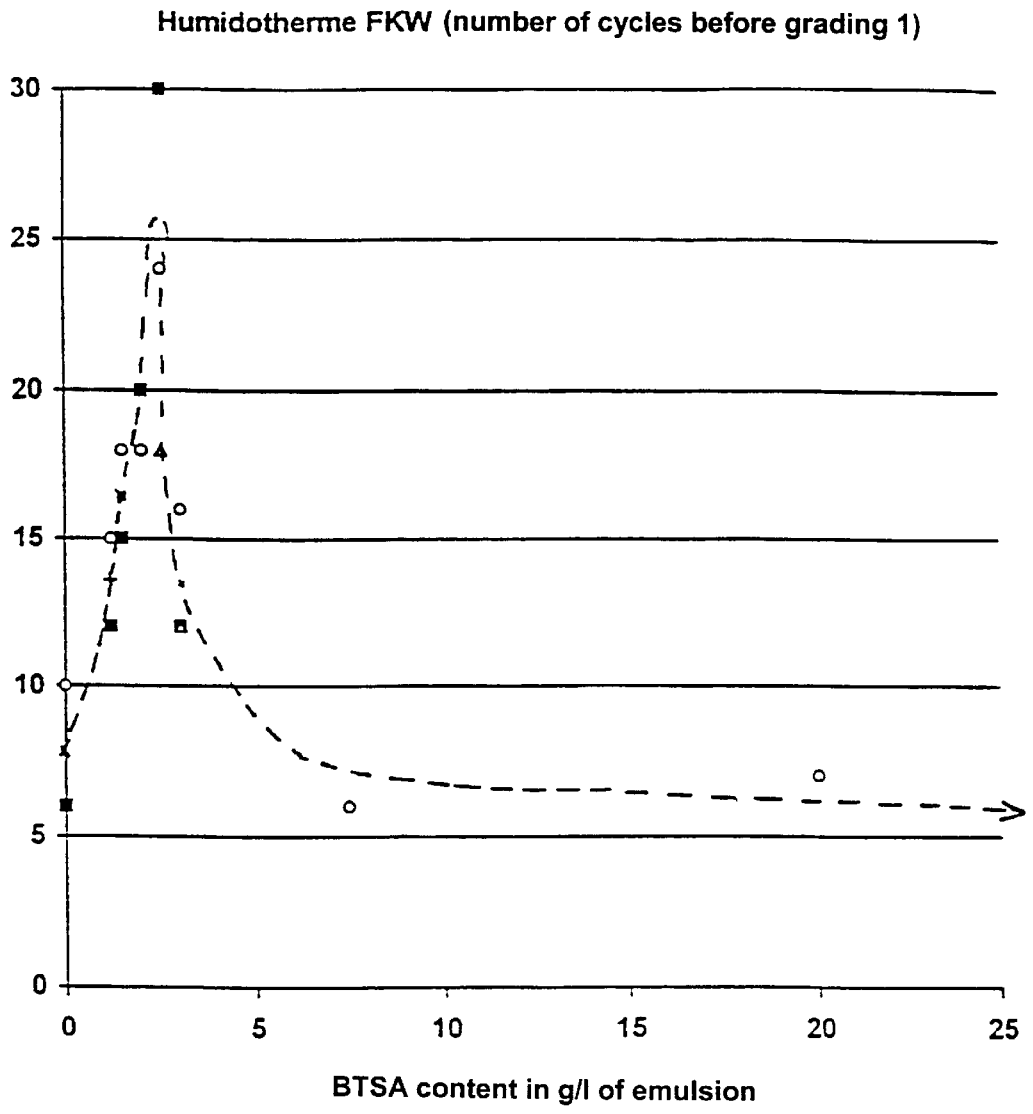
FIG. 1: Characterization of the optimum concentration of inhibitor of general formula I.

1) Benzothiazolylthiosuccinic acid in accordance with the invention, sold by Ciba under the name Irgacor 252.

The dissolution of the inhibitor BTSA in an oily emulsion is carried out after neutralization with aqueous ammonia or with ethanolamine.

By way of example, in order to neutralize and therefore dissolve 1 g of inhibitor in one litre of water, a minimum of 2 ml of aqueous ammonia or 0.2 ml of ethanolamine is needed.

These amounts of neutralizing agent can subsequently be increased (by a few tenths of an ml) in order to obtain a final pH (of the emulsion) of between 8.2 and 9.5.

2) Irgacor L184 and Irgamet 42 from Ciba.

Irgacor L184

This is a polycarboxylic acid amine salt of general formula as follows

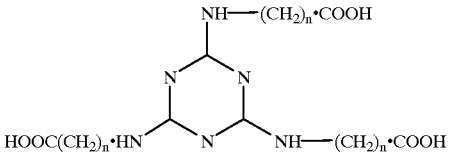

It is generally used with Irgamet 42, which is also soluble in water and of general formula as follows

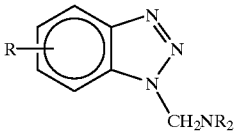

The proportion is 1 volume of Irgamet 42 per 19 volumes of Irgacor L184 (cf. compositions 4 and 5 in Table I below).

3) RC 305®, sold by Croda.

This is an aqueous mixture of alcoholamines of amine borates comprising 70% water.

4) PX 2881®, sold by Elf.

It is composed of an aqueous mixture of sodium heptanoate and of heptonoic acid with perborate.

5) SER AD FA 379, sold by Servo group Hüls.

This is a mixture of several inhibitors provided as paint additive. Its composition is as follows:

10–25% of $C_{12}$–$C_{14}$ (2-benzothiazolylthio)succinic acid tert amine salts 10–25% of ethoxylated tridecylalcohol phosphate-comprising monoethanolamine salts 10–25% of zinc salts of branched ($C_6$–$C_{19}$) fatty acids <2.5% of zinc salts of naphthenic acid 10–25% morpholine benzoate.

These inhibitors 1 to 5 are employed as additives in an emulsion composed of a soluble mineral oil and of water.

A. 2—Emulsion

The mineral oil employed is the soluble oil Castrol Aquasafe®.

It is composed of 80 to 95% of a mineral base (naphthenic and paraffinic). Surfactants are incorporated in this product in order to render it emulsifiable in water (anionic surfactant, sodium alkylsulphonates).

This soluble oil is diluted to 6% in demineralized water and the pH of the emulsion thus obtained is 9.2.

A. 3—Formulations Tested

Their compositions appear in Table I below.

TABLE I

| Composition | Typical concentration 1 (soluble oil) | Typical concentration 2 (inhibitor(s)) |
|---|---|---|
| -1- Castrol Aquasafe 21 emulsion (soluble oil alone) | 6% (60 g/l) | 0 |
| -2- (BTSA) (inhibitor alone) | 0 | Aqueous solution 30 g/l |
| -3- Composition 1 + composition 2 | 6% (60 g/l) | 2.5 g/l |

TABLE I-continued

| Composition | Typical concentration 1 (soluble oil) | Typical concentration 2 (inhibitor(s)) |
|---|---|---|
| -4- Irgacor L184 + Irqamet 42 | 0 | 30 g/l (L 184) and 1.5 g/l (I 42) |
| -5- Composition 1 + composition 4 | 6% (60 g/l) | 30 g/l (L 184) and 1.5 g/l (I 42) |
| -6- Composition 1 + PX2881 | 6% (60 g/l) | 15 ml/l |
| -7- Composition 1 + PX2881 | 6% (60 g/l) | 5 ml/l |
| -8- Composition 1 + RC305 | 6% (60 g/l) | 15 ml/l |
| -9- Composition 1 + RC305 | 6% (60 g/l) | 5 ml/l |

B) Methods

B 1—Electrochemical Measurement of Impedance—Transfer Resistance

The performances of the various compositions tested are assessed by applying them to test specimens of pickled steel, polished with G600 paper, in proportions such that the final grammage deposited on test specimens is of the order of 500 mg/m$^2$ (0.5 $\mu$m). The test specimen is subsequently immersed in an electrolyte composed of demineralized water and of 1% by weight of sodium chloride (NaCl). The steel test specimen is held in the electrolyte for 30 min in order to stabilize its electrochemical potential. After 30 min, using a potentiostat, a frequency analyser, a reference electrode and a counterelectrode, a sinusoidal perturbation in potential (in mV) is imposed on the test specimen for various decreasing frequencies and "the response intensity" (in $\mu$A/cm$^2$) is measured.

It is thus possible to obtain impedances (Z =U/I for the various frequencies and to draw impedance diagrams. From these diagrams, a transfer resistance (ohm.cm$^2$) can be deduced therefrom and can be compared to a "corrosion resistance".

| Experimental parameters | |
|---|---|
| - Reference electrode | saturated calomel electrode |
| - Counterelectrode | platinum electrode |
| - Working electrode | 7 cm$^2$ steel test specimen |
| - Potentiostat | EGG 273 ® potentiostat |
| - Frequency analyser | Schlumberger 1255 ® |
| - Sinusoidal perturbation | ±5 mV in amplitude |
| - Test potential | corrosion potential |
| - Frequencies | from 100,000 Hz to 0.2 Hz |

B 2—Validation by "Humidotherme FKW" Test (DIN 50017 Standard)

To do this, steel test specimens, coated with the various compositions to be tested, are suspended in a chamber with the following cycle 1 cycle=8 hours at 40° C. and 100% humidity
16 hours at 20° C. and 75% humidity The number of cycles before the appearance of corrosion is thus recorded. The thickness of the films applied is 0.5 g/m$^2$ on average (0.5 $\mu$m). Without contrary indications, the composition is always composed of Castrol Aquasafe 21 soluble oil diluted to 6% in demineralized water.

B 3—EB1 Area and Finishing Area Test

The test specimens are exposed to the atmosphere of 2 storage areas finishing area area with a relatively mild atmosphere (closed doors)

EB1 area very harsh area because the test specimens are exposed close to the openings to this area and are therefore subjected to a high humidity when it rains, to exhaust gases from lorries and to steelworks dust.

In both cases, the number of days before the appearance of corrosion is recorded.

EXAMPLE 1

Determination of the Optimum Concentration of Inhibitor with Regard to Corrosion Stability Inhibitor BTSA, neutralized with ethanolamine, is introduced at concentrations varying between 0.5 and 20 g/l in the aqueous phase into a composition according to the invention comprising an aqueous emulsion based on 6% Castrol Aquasafe 21 oil. The corrosion resistances of the various corresponding compositions are determined by Humidotherme FKW according to the procedure described in Material and Method. The results obtained are represented in the graph in FIG. 1.

Optimum resistance is observed with the composition comprising 2.5 g/l of inhibitor BTSA in the neutralized form.

EXAMPLE 2

Appraisal of the Corrosion Resistance After Atmospheric Exposure

This appraisal is carried out with a composition according to the invention comprising a concentration of BTSA of 2.5 g/l (composition 3) and in comparison with the control compositions 1, 2 and 4, identified more specifically in the chapter Materials and Methods.

These compositions are subjected to EB1 area and finishing area tests, the protocols for which are explained in Materials and Methods.

The results observed with each of the compositions are presented in Table II below.

TABLE II

| Composition | Number of days before the appearance of corrosion (EB1 area) | Number of days before the appearance of corrosion (finishing area) |
|---|---|---|
| 1 | 15 to 25 days | 66 days |
| 2 | 2 to 6 days | 15 days |
| 3 | 30 to 65 days | 110 days |
| 4 | 3 days | |
| 5 | 10 to 20 days | |

It is noticed that only the composition according to the invention, that is to say composition 3, comprising a salt of BTSA in an aqueous emulsion, exhibits a resistance which is significantly prolonged over time. What is more, the increase in the resistance observed is markedly greater than that resulting from the superimposition of the resistances induced respectively by the emulsion and by BTSA considered in isolation. There is advantageously a synergy in their respective effects.

EXAMPLE 3

Appraisal of the Resistance According to a Transportation Test

This test is also carried out on the compositions 1, 2, 3 and 4, identified more specifically in the chapter Materials and Methods.

This test consists in stacking test specimens which have been coated beforehand with the solutions to be tested. The stacks are held clamped in order to simulate the contiguous turns of a steel coil or the stacked sheets of a pile of metal sheets.

The pile of stacked test specimens ("clamped pile") is subsequently introduced into a programmed climatic chamber in order to carry out an alternation of 32 h cycles ("transportation cycle").

Breakdown of the transportation cycle (1 cycle =32 hours)

10 h at 40° C. and 95% RH 4 h at 20° C. and 80% RH 10 h at −5° C. and 0% RH 8 h at 30° C. and 85% RH In the "transportation cycle" configuration, the tests are carried out on clamped piles under the following conditions:

each scenario is represented by 4 test specimens, observations are made every three cycles. The piles are opened and the condition of the interfaces is observed.

The results appear in Table III below.

TABLE III

| Compositions | Number of cycles before the appearance of corrosion |
|---|---|
| 1 | <6 cycles |
| 2 | <6 cycles |
| 3 | >19 cycles |
| 4 | <6 cycles |
| 5 | <6 cycles |

Only the metal component coated with a composition according to the invention, that is to say composition 3, displays a significantly improved corrosion resistance. Furthermore, this increase reflects a synergy between the emulsion and the BTSA salt.

EXAMPLE 4

Validation for Humidotherme Test

Validation is carried out according to the protocol described in the chapter Materials and Methods on the compositions 1 to 9 defined in this same chapter.

Apart from the compositions 2 and 4, based on an aqueous solution respectively comprising BTSA and an Irgacor L184/Irgamet 42 mixture, the tested compositions are always composed of Castrol Aquasafe 21 soluble oil diluted to 6% in demineralized water (composition 1) with various inhibitors added (compositions 3 and 5 to 9).

The results presented in Table IV below are observed.

TABLE IV

| Compositions | Number af cycles before the appearance of corrosion |
|---|---|
| 1 | 12 cycles |
| 2 | 1 cycles |
| 3 | >22 cycles |
| 4 | 1 cycle |
| 5 | <12 cycles |
| 6 | 12 cycles |

TABLE IV-continued

| Compositions | Number af cycles before the appearance of corrosion |
|---|---|
| 7 | 8 cycles |
| 8 | 12 cycles |
| 9 | 15 cycles |

By this test, it is confirmed that the various control inhibitors tested do not have the effectiveness of the product BTSA. The existence of a synergy solely between an inhibitor of general formula I and of an Aquasafe 21 emlsion is also confirmed by this test.

EXAMPLE 5

Appraisal of the Corrosion Resistance Through the Transfer Resistance

This test was carried out by drawing up the electrochemical impedance diagrams of the compositions 1 and 3 identified in the chapter Materials and Methods, tested according to the protocol described in this same chapter. The results appear in Table V below.

TABLE V

| Compositions | Transfer resistances in kΩ.cm$^2$ |
|---|---|
| 1 | 10 to 20 kΩ.cm$^2$ |
| 3 | 60 to 120 kΩ.cm$^2$ |

EXAMPLE 6

Effect of the Concentration of BTSA Salt in the Interfacial Film on the Corrosion Resistance Impedance curves were drawn up, according to the protocol described in the chapter Materials and Methods, for metal components coated with the following compositions:

2) emulsion alone 3) emulsion +5% aqueous BTSA solution, without drying 4) emulsion +5% aqueous BTSA solution, then drying at 60° C. in order to obtain a 650 mg/m$^2$ film 5) emulsion +3.5% aqueous BTSA solution, then drying at 60° C. in order to obtain a 250 mg/m$^2$ film 6) emulsion +3.5% aqueous BTSA solution, then drying at 60° C. in order to obtain a 700 mg/m$^2$ film.

In the emulsions 3 to 6, the BTSA is present in a form neutralized with aqueous ammonia. Drying of the emulsions 4 to 6 therefore results in evaporation of ammonia.

Figure 2:
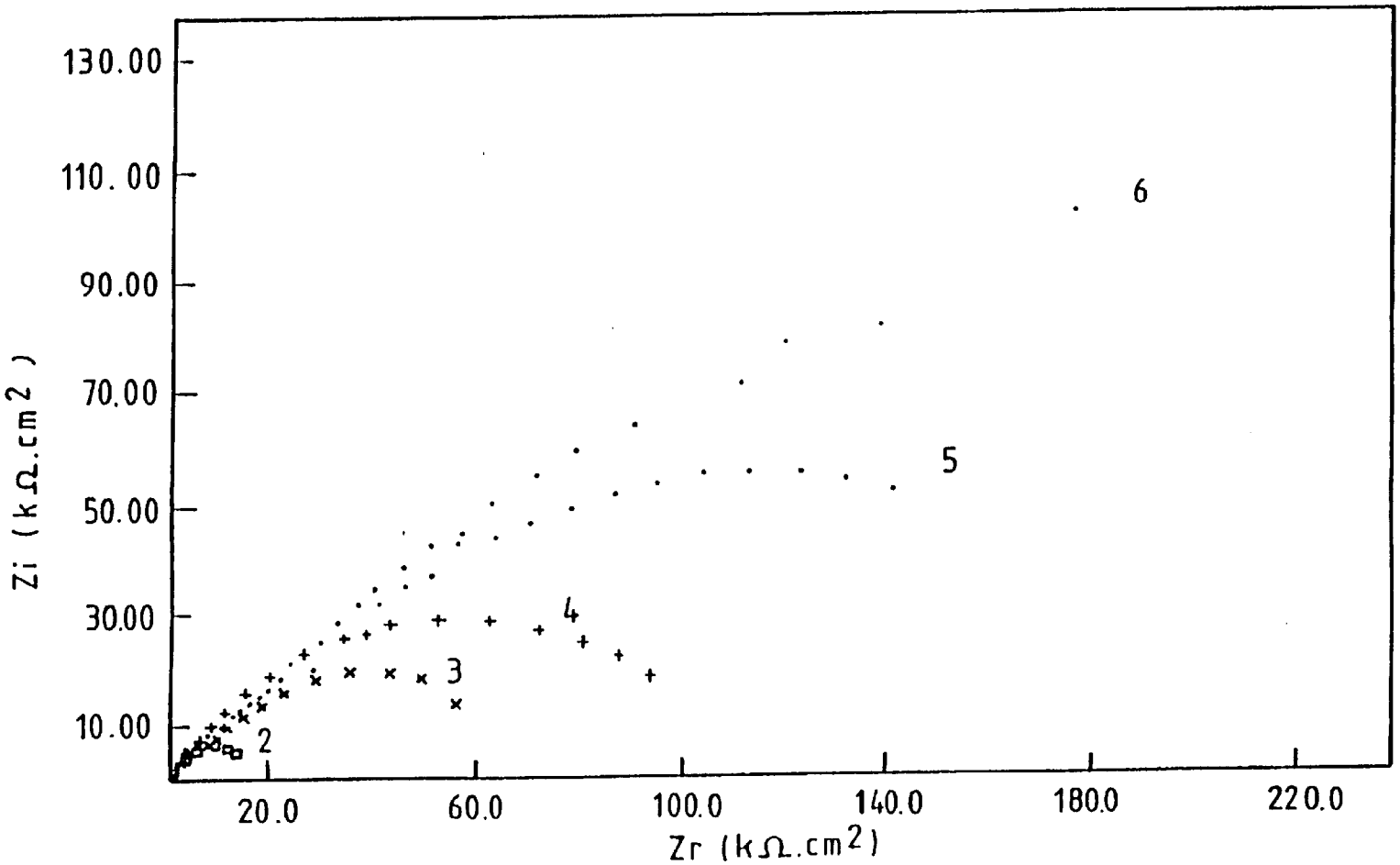
FIG. 2: Impedance characterization of films according to the invention and of control films.

The results are presented in FIG. 2, with the real part of the impedance expressed on the abscissa and the imaginary part of the impedance on the ordinate.

From examination of these curves, it emerges that, at equivalent film thickness, a better behaviour is observed with a film obtained with 3.5% of BTSA (composition 4) than 5% of BTSA (composition 6). An excess of BTSA in the resulting film therefore has an unfavourable effect.

Furthermore, it may be noted that carrying out a drying stage (composition 4) confers an advantageous behaviour on the corresponding film in comparison with a film which has not been subjected to drying (composition 3). This effect is in fact related to the use of BTSA neutralized with aqueous ammonia.

EXAMPLE 7

Effect of the Preparation Protocol on the Effectiveness of a Composition According to the Invention The performances of a composition prepared according to the process of the invention and of a composition prepared by addition of BTSA to the soluble oil prior to its emulsion are compared in terms of corrosion resistance. The results are presented in Table VI below.

TABLE VI

| | EB1 area test | Humidothermes FKW test | Transportation test | Transfer resistances $R_T$ kΩ.cm$^2$ |
|---|---|---|---|---|
| Composition. 2.5 g/l of BTSA diluted in the 6% emulsion | 30 to 65 d | >22 cycles | >19 cycles | 70 |
| 2.5 g/l of BTSA diluted in the soluble oil before emulsion. Emulsion subsequently prepared | 45 d maximum | 20 cycles | 15 cycles | 20 |

The total resistances are determined by electrochemical impedance, carried out according to the protocol described in the preceding chapter Material and Method.

From these results, it emerges that the method of addition of the BTSA to the composition according to the invention has a not insignificant effect.

In equal amounts, if it is dissolved in the soluble oil before emulsifying, the performance is significantly reduced in terms of corrosion resistance.

EXAMPLE 8

Friction Characterization of the Compositions Provided

The single-pass friction tests are carried out with plane-plane friction, at a variable transversable pressure of 200 to 2000 daN, with tools made of high-speed steel with an area of 1 cm$^2$. The rate of displacement is 2 mm/s.

The test specimens are cut from pickled hot metal sheets, grade BS2, with a thickness of 2 mm.

Figure 3:
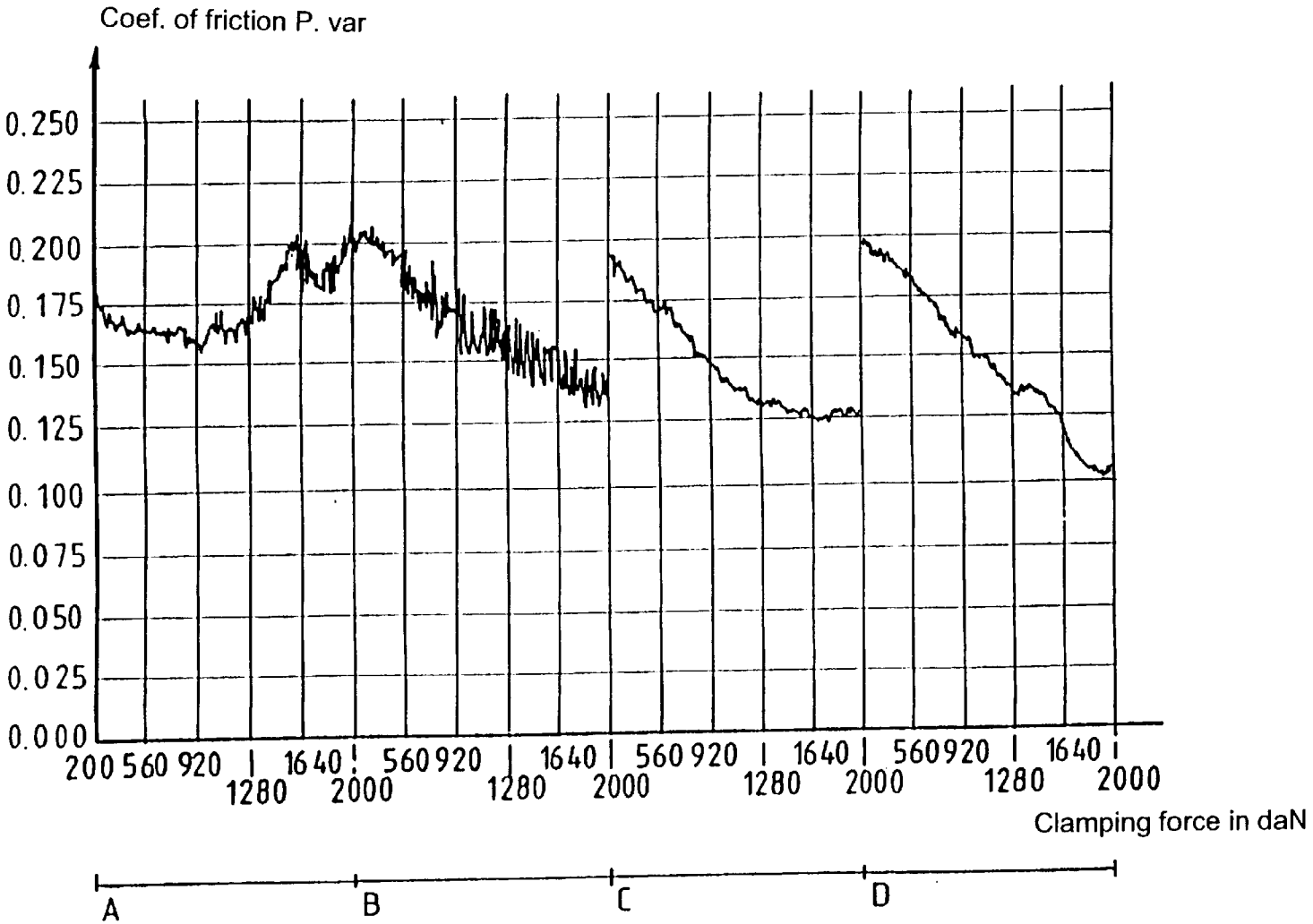
FIG. 3: Friction characterization of a film according to the invention and of control films.

The performances of two compositions according to the invention are compared with two control compositions, the tribological behaviour of which compositions appears in FIG. 3.

Composition A: a protecting oil used on steel sheets as protection from corrosion (Quaker 8021), deposited in a proportion of 2 g/m$^2$ Composition B: the Aquasafe 21 soluble oil at 6% in water, deposited in a proportion of 500 g/m$^2$ Composition C: Composition B with organic inhibitor BTSA added in the salt form (pH of the solution between 7.2 and 8.5), deposited in a proportion of 500 mg/m$^2$ Composition D: identical to Composition C, the pH of which is stabilized between 8.5 and 9 by the addition of ethanolamine, deposited in a proportion of 500 mg/m$^2$.

The friction curves improve with Compositions C and D. The results obtained are better than with a protecting oil having stamping properties (Composition A).

EXAMPLE 9

Characterization of the Adsorption Power of the Inhibitor BTSA

According to a first method, wettability measurements are carried out on two compositions, a composition based on an Aquasafe 21 emulsion (Control) and a composition based on an Aquasafe 21 emulsion to which has been added BTSA (BTSA) at a concentration of 2.5 g/l in the form of its neutralized salt, the pH being of the order of 8.5 to 9.

The test consists in depositing a drop of each of the emulsions on a steel test specimen and in monitoring the change in contact angle of the drop (monitoring of the spreading).

Figure 4:
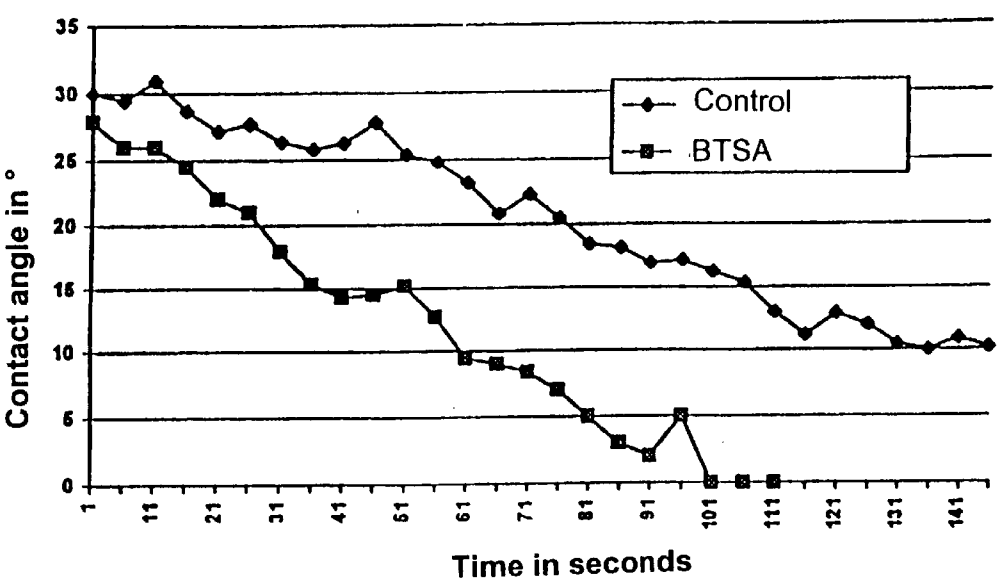
FIG. 4: Characterization of the adsorption power of a corrosion inhibitor of general formula I at the surface of a metal component.
Figure 4:
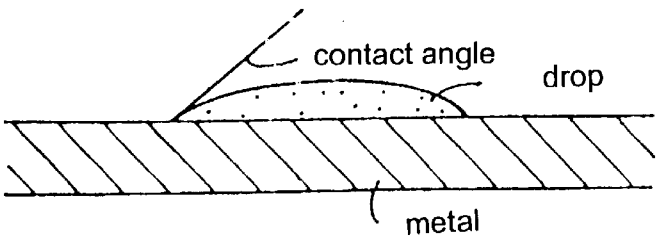

The graph represented in FIG. 4 shows that a drop of Aquasafe 21 emulsion to which BTSA has been added (BTSA) spreads much more quickly over the steel than a drop of conventional Aquasafe 21 emulsion (Control). These results show that BTSA acts as a spreading agent. It contributes to rendering a film more homogeneous and to giving it a greater covering power.

This adsorption power is also assessed by infrared spectrum according to the following protocol and with the compositions defined below in Table VII.

In all cases, the tested compositions comprise an emulsion exhibiting a concentration of Aquasafe 21 oily base of 5%.

TABLE VII

| Composition | Concentration of BTSA | BTSA dissolved in: | pH of the emulsions |
|---|---|---|---|
| A | 0.25% | oil | 9.7 |
| B | 0.125% | oil | 10.1 |
| C | 0.25% | emulsion | 9 |
| D | 0.75% | emulsion | 8.9 |
| E | 3.75% | emulsion | 10.2 |

The emulsions A, B, C, D and E are applied to polished test specimens. In order to study the film-steel interface, the infrared spectrum is run on the test specimen after leaching with acetone (grazing incidence FTIR spectra, 80° angle of incidence). It is thus observed that the films A and B are completely removed by the leaching. It may therefore be deduced therefrom that the inhibitor is weakly adsorbed in the case of these compositions.

after leaching the films C, D and E, an interfacial film remains, the thickness of which increases with the initial concentration of inhibitor. Likewise, the content of inhibitor in these residual interfacial films (base oil+inhibitor) increases with the final concentration.

This test therefore confirms that it is preferable to add the inhibitor BTSA to the Solclean emulsion and not to the base oil before emulsification (Composition C in comparison with A). Thus, the inhibitor can be strongly adsorbed on the steel and have an optimum effect. These spectra are perfectly consistent with the corrosion tests.

From their examination, it also emerges that the performances are poorer when BTSA is found in the thickness of the film of dried oil, that is to say in the effluents from the leaching. This is particularly the case with the composition E, which comprises 3.75% of BTSA.

EXAMPLE 10

Figure 5:
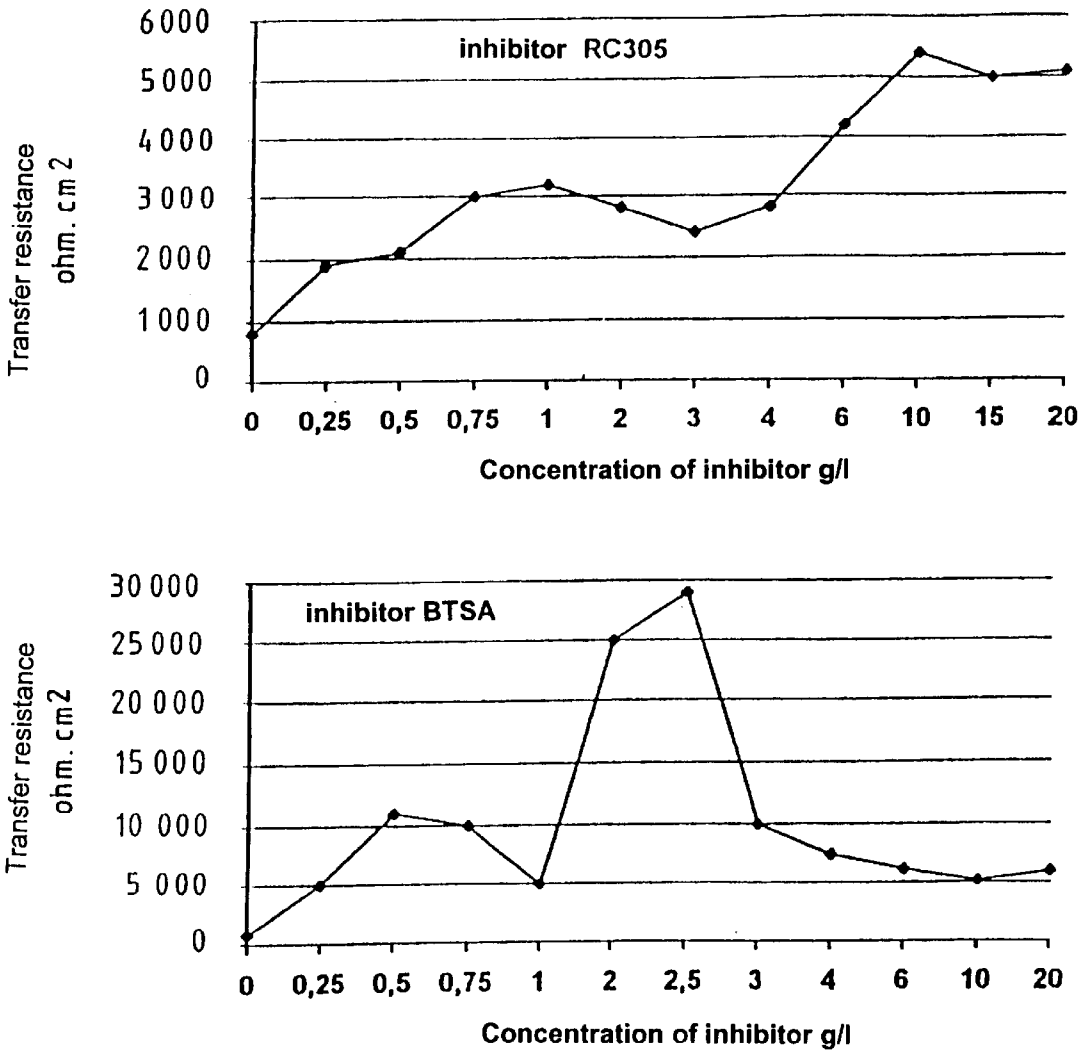
FIGS. 5 and 6: Characterization of the adsorption power of various inhibitors, including BTSA.
Figure 6:
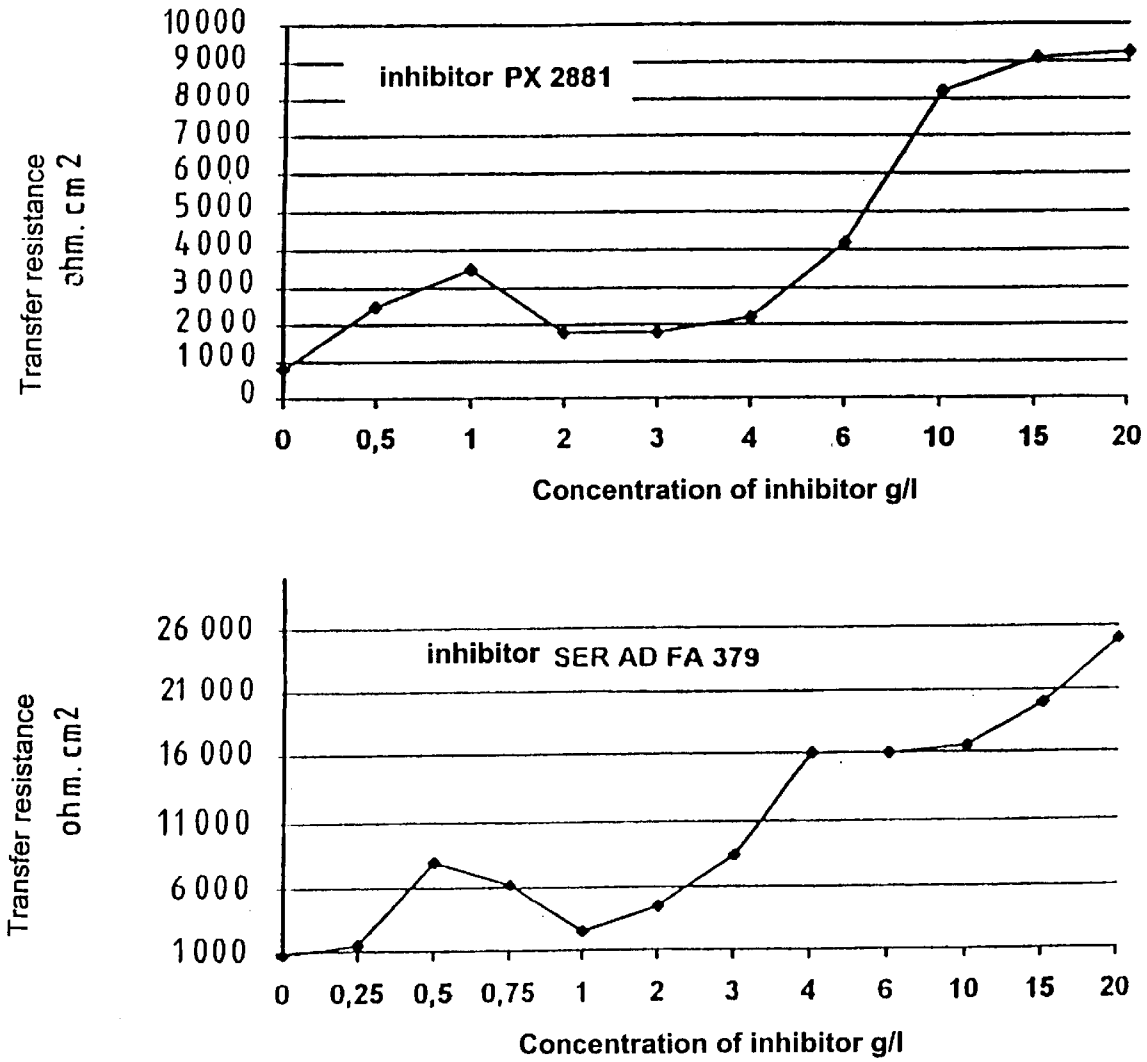

Comparison of the Adsorption Power or of BTSA With Respect to Other Water-soluble or Water-solubilized Corrosion Inhibitors The effect of the concentration of BTSA neutralized with ethanolamine in aqueous solution, applied to a bare steel sheet, is compared with that of the inhibitors RC 305, PX 2881 and SER AD FA 379 identified in the chapter Material and Method. This effect is assessed by electrochemical measurements of impedances according to the protocol described above. The various inhibitors are tested at between 0.5 and 20 g/l and the transfer resistances ("corrosion resistance") obtained are represented in the graphs in FIGS. 5 and 6. It appears that only the inhibitor BTSA exhibits an optimum adsorption peak at the surface of the bare metal sheet, with the peak centred on 2.5 g/l. As regards the other inhibitors tested, they display an increasing effectiveness with concentration but an effectiveness which is always inferior to that of BTSA (30,000 $\Omega \cdot cm^2$ at 2.5 g/l). As regards the inhibitor SER AD FA 379, the content of BTSA in this inhibitor is too low to observe results in accordance with the invention in the inhibitor concentration range under consideration.

This behaviour of the inhibitors in aqueous solution can in fact be extrapolated to corresponding solutions, comprising an oily phase, according to the invention.

What is claimed is:

1. Composition for conferring temporary protection from corrosion on metal surfaces comprising an oil-in-water emulsion comprising, in its aqueous phase, at least one compound of general formula I

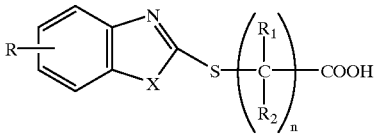

in which formula the R, $R_1$ and $R_2$ groups are, independently of one another, a hydrogen atom, a $C_1$ to $C_{20}$ alkyl group, a $C_1$ to $C_{20}$ haloalkyl group, with the halogen being chlorine, bromine, iodine or fluorine, a $C_3$ to $C_6$ cycloalkyl group, a carboxyl functional group or a $C_1$ to $C_6$ carboxyalkyl group, n is an integer varying from 1 to 3, and X is a sulphur or oxygen atom, in the form of one of its water-soluble salts, characterized in that the said emulsion is obtained by emulsification of an aqueous phase, in which the said compound of general formula I has been incorporated beforehand, with an oily phase.

2. Composition according to claim 1, wherein the compound of general formula I is selected from the water-soluble salts of benzothiazolylthiosuccinic, α-(benzothiazolylthio)stearic, α-(benzathiazolylthio)lauric, α-(benzothiazolylthio)caproic and α-(benzothiazolylthio) caprylic acids.

3. Composition according to claim 1, wherein the compound of general formula I is a water-soluble salt of benzothiazolylthiosuccinic acid.

4. Composition according to claim 3, wherein said water-soluble salt is an ethanolamine or ammonium salt.

5. Composition according to claim 1, wherein the pH of said composition is between 8.2 and 9.5.

6. Composition according to claim 1, wherein the emulsion comprises, in dispersion in water, 3 to 13% by volume of an oily phase comprising from 75 to 90% by volume of at least one oil, and from 5 to 10% by volume of at least one surface-active agent.

7. Composition according to claim 1, wherein the emulsion comprises, in dispersion in the aqueous phase, between 3 and 8% by volume of an oil.

8. Composition according to claim 6, wherein the oil present in the oily phase of said composition is a mineral oil.

9. Composition according to claim 1, wherein the compound of general formula I is present in the said composition at a concentration of between 1 and 10 g/l of emulsion.

10. Composition according to claim 1, which comprises between 1 to 3.5 g/l of said compound of said general formula I.

11. Composition according to claim 1, which comprises between 1 and 3.5 g/l of benzothiazolylthiosuccinic acid in the form of a water-soluble salt in the aqueous phase of an emulsion comprising 6% of soluble oil.

12. Composition according to claim 11, wherein said water-soluble salt is an ammonium benzothiazolythiosuccinate, present at a concentration of the order of 2.5 g/l.

13. Process for temporarily protecting a metal component from corrosion, which comprises the stages consisting in:

applying a composition according to claim 1 to at least a part of the said metal component, and drying the coated metal component so-obtained until a dry film is obtained.

14. Process according to claim 13, wherein the composition is applied so as to saturate the adsorption sites at the surface of the metal component with a compound of general formula I and in that, on conclusion of the drying of the said composition, in order to obtain a dry film therefrom, the compound of general formula I is not found present in the thickness of the applied film.

15. Metal component coated with the dry film for temporary protection from corrosion obtained according to the process of claim 13.

16. Metal component according to claim 15 with a surface density of dry film of between 0.3 and 2 $g/m^2$.

17. Metal component coated with the dry film for temporary protection from corrosion obtained from a composition as defined according to claim 1.

18. Composition according to claim 6, which further comprises in the oily phase from 5 to 15% by volume of a corrosion inhibitor.

19. Composition according to claim 18, wherein the corrosion inhibitor of the oily phase is a carboxylic acid, a barium or sodium alkylsulphonate or a fatty acid amine salt.

20. Composition according to claim 8, wherein the oil is at least one selected from the group consisting of parrafinic and naphthenic oil.

* * * * *